US011766885B2

(12) United States Patent
Riedl et al.

(10) Patent No.: US 11,766,885 B2
(45) Date of Patent: Sep. 26, 2023

(54) SECURITY DOCUMENT AND METHOD FOR PRODUCING A SECURITY DOCUMENT

(71) Applicant: VERIDOS GMBH, Berlin (DE)

(72) Inventors: Josef Riedl, Attenkirchen (DE); Gunter Endres, Munich (DE); Klaus Kohl, Miesbach (DE)

(73) Assignee: VERIDOS GMBH, Berlin (DE)

( * ) Notice: Subject to any disclaimer, the term of this patent is extended or adjusted under 35 U.S.C. 154(b) by 0 days.

(21) Appl. No.: 17/274,903

(22) PCT Filed: Sep. 10, 2019

(86) PCT No.: PCT/EP2019/000263
§ 371 (c)(1),
(2) Date: Mar. 10, 2021

(87) PCT Pub. No.: WO2020/052796
PCT Pub. Date: Mar. 19, 2020

(65) Prior Publication Data

US 2022/0041004 A1 Feb. 10, 2022

(30) Foreign Application Priority Data

Sep. 12, 2018 (DE) ..... 10 2018 007 207.0

(51) Int. Cl.
*B42D 25/324* (2014.01)
*B42D 25/23* (2014.01)
(Continued)

(52) U.S. Cl.
CPC ..... *B42D 25/324* (2014.10); *B42D 25/23* (2014.10); *B42D 25/309* (2014.10); *B42D 25/455* (2014.10); *B42D 25/46* (2014.10)

(58) Field of Classification Search
CPC ..... B42D 25/324
See application file for complete search history.

(56) References Cited

U.S. PATENT DOCUMENTS 4,765,656 A * 8/1988 Becker ..... G06K 19/14 283/70
5,443,579 A * 8/1995 Tanaka ..... B42D 15/00 283/93
(Continued)

FOREIGN PATENT DOCUMENTS

DE 3634865 A1 * 6/1987
DE 102005011612 A1 2/2006
(Continued)

OTHER PUBLICATIONS

WO-2014096167-A1 English Translation (Year: 2014).*
(Continued)

*Primary Examiner* — Kyle R Grabowski
(74) *Attorney, Agent, or Firm* — WORKMAN NYDEGGER

(57) ABSTRACT

A security document has a carrier element which has a surface with a principal plane and a personalization region. A personalization layer is applied to the surface, such that the surface of the carrier element in the personalization region is configured with a plurality of structure elements uniformly aligned with each other and raised with respect to the principal plane. The structure elements of the plurality of structure elements are configured immediately adjacent to each other and the structure elements are configured with a center distance between vertical axes of the respective structure elements of less than 250 μm.

14 Claims, 2 Drawing Sheets

(51) Int. Cl.

| | |
|---|---|
| ***B42D 25/309*** | (2014.01) |
| ***B42D 25/455*** | (2014.01) |
| ***B42D 25/46*** | (2014.01) |

(56) References Cited

U.S. PATENT DOCUMENTS

| | | | | |
|---|---|---|---|---|
| 6,176,521 | B1 * | 1/2001 | Mancuso | B41M 1/14 283/91 |
| 7,048,307 | B1 * | 5/2006 | Scarbrough | B42D 15/02 283/107 |
| 7,354,072 | B2 * | 4/2008 | Yokote | B41M 3/14 283/113 |
| 8,100,436 | B2 | 1/2012 | Heine et al. | |
| 2007/0246932 | A1 * | 10/2007 | Heine | B42D 25/378 283/94 |
| 2009/0214105 | A1 * | 8/2009 | van den Berg | B42D 25/435 382/154 |
| 2013/0154250 | A1 | 6/2013 | Dunn et al. | |
| 2013/0171423 | A1 | 7/2013 | Cruikshank | |

FOREIGN PATENT DOCUMENTS

| | | | | |
|---|---|---|---|---|
| DE | 102005052562 | A1 | 5/2007 | |
| DE | 102009004128 | A1 * | 7/2010 | B42D 25/425 |
| DE | 102009004128 | A1 | 7/2010 | |
| DE | 102010035890 | A1 | 3/2012 | |
| DE | 102010062046 | A1 | 5/2012 | |
| DE | 102016012625 | A1 | 4/2018 | |
| WO | 2006110038 | A2 | 10/2006 | |
| WO | WO-2007051530 | A2 * | 5/2007 | B42D 25/00 |
| WO | WO-2014096167 | A1 * | 6/2014 | B42D 25/324 |
| WO | 2015055813 | A1 | 4/2015 | |
| WO | 2016153345 | A1 | 9/2016 | |

OTHER PUBLICATIONS

Office Action from corresponding German Application No. 102018007207.0, dated Jun. 26, 2019.

International Search Report and Written Opinion from PCT Application No. PCT/EP2019/000263, dated Nov. 27, 2019.

* cited by examiner

SECURITY DOCUMENT AND METHOD FOR PRODUCING A SECURITY DOCUMENT

BACKGROUND

The invention relates to a security document having a carrier element. The carrier element has a surface. The surface has a principal plane and a personalization region. In the personalization region, a personalization layer is applied to the surface.

Security documents are known as cards or data carriers, for example. A security document can thus be configured as a bank card, credit card or identification document, for example.

Security documents are personalized, for example, with a superficially applied photo. The superficial personalization can be effected, for example, by means of D2T2 (dye diffusion thermal transfer), thermal transfer printing or an inkjet system.

The disadvantage is that the personalization loses intensity in the course of the working life and in the worst case is no longer recognizable. In the case of bank cards, credit cards, etc., but also in the case of identification documents, attempts are made to protect this personalization with an overlying protective layer, for example lacquer or foil. However, the use of the protective layer means additional effort and costs. In addition, the protective layer can wear off or peel off with regular mechanical load.

SUMMARY

It is the object to create a security document and to provide a method for manufacturing a security document in which a superficial personalization is protected more efficiently.

A security document according to the invention has a carrier element. The carrier element has a surface. The surface has a principal plane and a personalization region. In the personalization region, a personalization layer is applied to the surface. As an important idea, it is provided that the surface of the carrier element in the personalization region is configured with a plurality of structure elements uniformly aligned with each other and raised with respect to the principal plane, the structure elements of the plurality of structure elements being configured immediately adjacent to each other, and the structure elements being configured with a center distance between vertical axes of the respective structure elements of less than 250 μm, preferably 200 μm, more preferably 150 μm, still more preferably 130 μm, in particular 120 μm. In particular, the structure elements are configured as, preferably straight, semicircular rods with an extension at least three times, preferably four times, in particular five times longer in the direction of the longitudinal axis of the semicircular rods than in the direction of the transverse axis of the semicircular rods. In particular, the personalization layer is applied onto the structure elements already created in particular by lamination.

The invention is based on the finding that the personalization layer, due to a defined surface structure or the plurality of raised structure elements and the thus enlarged surface in contrast to a flat surface, remains more recognizable or is less worn or eroded even after mechanical and/or chemical load.

It has been recognized that the normal mechanical load, for example when the security document is inserted into a card holder, a card reader or wallet, or when a user touches the security document with his fingers, in the presence of the plurality of raised structure elements substantially occurs only in a small region of the respective structure element in relation to the entire surface. For example, the mechanical load occurs substantially only in the partial region of the respective structure element that faces away from the carrier element, for example a spherical cap of the respective structure element. However, due to the plurality of structure elements, the mechanical load is effected substantially not between the structure elements, in particular not in the principal plane.

In particular, the principal plane runs through respective parts of the structure elements which are closest to the carrier element. Preferably, the principal plane runs parallel to the carrier element or to a longitudinal axis of the carrier element. The principal plane can also extend, for example, through a smooth, i.e. structure element-free part of the surface of the carrier element or extend parallel offset to the surface.

The personalization layer is applied in particular to the structure elements, i.e. the personalization layer lies above the structure elements. In other words, the structure elements are covered by the personalization layer.

In particular, the personalization layer is applied to the surface subsequently, i.e. after the production of the structure element or the structure elements. Preferably, the personalization layer is applied subsequently to the already laminated structure elements.

The plurality of structure elements is in particular configured such that the personalization layer is not or only insignificantly disturbed or impaired and that the regions in which the personalization is removed primarily by abrasion are not or only slightly recognizable to the human eye. Thus, in the eye of the viewer, again an overall picture is created. Due to the center distance between the vertical axes of the respective structure elements of less than 180 nm, the structure elements are smaller than the resolving power of a naked human eye.

Also, a chemical load on the personalization can be reduced by the plurality of structure elements. A chemical such as e.g. skin grease, which is applied to the security document for example by an object external to the security document, such as fingers, can attack the personalization layer substantially only in the regions which are touched by the object external to the security document. A user's finger substantially only rests on the tip of the respective raised structure element facing away from the carrier element, but not in interstices of the respective structure elements or not on the partial regions of the respective structure element not belonging to the tip.

Due to the immediate adjacency of the structure elements, the distance between the structure elements is smaller and it can be prevented more efficiently that an object external to the security document penetrates between the structure elements and damages the personalization layer there.

In particular, the plurality of structure elements is configured as a lens structure, a knobbed structure, a cam structure, a nipple structure or a lug structure. Further in particular, a respective structure element of the plurality of structure elements has a dome-shaped surface facing away from the carrier element.

The security document is configured in particular as a card or data carrier. In particular, the security document is also configured as a bank card, credit card or identification document.

The personalization layer is configured in particular as a long-term resistant, colored personalization. For example, the personalization layer can be configured as a photo, for example of a human face.

The security document may also have several surfaces, for example front side and back side. Each surface may have several personalization regions. The personalization regions can be directly adjacent to each other or be configured spaced apart from each other.

The personalization region is preferably limited to a partial region of the surface, in particular to the partial region in which the personalization layer is located. In a less preferred embodiment, however, the personalization region can also extend over the entire surface.

Preferably, the structure elements are made of the same material as the carrier element. In particular, the carrier element is configured of metal or preferably plastic and the structure elements are applied to the carrier element subsequently, for example by gluing, or are already created during fabricating the carrier element, for example by milling or by a mould. In particular, the structure elements are not created by embossing on the carrier. The structure elements are therefore different from embossing elements, such as for example those applied to bank notes.

In the case of a center distance of less than 150 μm, in particular 130 μm, the structure elements are almost not recognizable or unrecognizable to the human eye without (magnifying) visual aids and are thus not disturbing.

Preferably, it is provided that at least one structure element of the plurality of structure elements has at least partly an arc-shaped contour in a cross-section perpendicular to the principal plane. Preferably, the majority, in particular the entirety, of the structure elements of the plurality of structure elements has the arc-shaped contour in a cross-section perpendicular to the principal plane. Due to the arc-shaped contour, a large part of the surface can be captured from an externally arranged observation point without any regions being non-visible, as would be the case, for example, with an angular, in particular quadrangular, contour. The personalization layer can thus be better captured.

Further preferably, it is provided that at least one structure element of the plurality of structure elements is configured superficially dome-shaped on the side facing away from the carrier element. Due to the dome-shaped design, contact with an object wearing off the personalization layer can be kept to a minimum, in particular if this object is configured with a flat area, as then substantially only the tip or the region of the structure element configured parallel to the principal plane comes into contact with the object wearing off the personalization layer.

Further preferably, it is provided that at least one structure element of the plurality of structure elements is configured as a spherical segment, in particular as a hemisphere, and the sectional area of the spherical segment faces the carrier element and is arranged in particular in the principal plane. The spherical segment shape is advantageous because merely a relatively small part of the structure element is exposed to normal mechanical load and at the same time a pleasant tactile perception is made possible. In addition, as a result the respective structure element is configured in a non-pointed manner or round in such a way that injury, for example to a fingertip, is avoided.

Further preferably, it is provided that at least one structure element of the plurality of structure elements is configured as a semicircular rod and in particular the flat principal area of the semicircular rod is arranged in the principal plane. In particular, several structure elements of the plurality of structure elements are respectively formed as semicircular rods. In particular, grooves are formed between the individual semicircular rods. The grooves run in particular in the principal plane or in particular at least parallel to the principal plane. The configuration as a semicircular rod is advantageous, as this exposes the personalization layer to less mechanical load.

Preferably, the semicircular rods extend over the entire length or width of the personalization region. Further preferably, the semicircular rods are configured in a straight manner. Further preferably, the semicircular rods are configured without interruptions in the direction of their longitudinal axis, i.e. in each row or each column, depending on whether the semicircular rods are aligned horizontally or vertically or diagonally to the viewer, there is arranged only one semicircular rod which extends in particular over the entire length.

Each of the semicircular rods can then have a length along the longitudinal axis of up to several cm, for example 0.5 cm to 20 cm, preferably 1 cm to 10 cm, in particular 2 cm to 5 cm.

Preferably, the semicircular rods are at least more than three times longer in the direction of the longitudinal axis of the semicircular rods, in particular more than four times longer than wide in the direction of the transverse axis of the semicircular rods.

The semicircular rods are preferably arranged immediately next to each other in the direction of the transverse axes of the semicircular rods, i.e. without spacing.

The semicircular rods can also be called bars, which are rounded on the side facing away from the carrier element, in particular in the transverse direction, i.e. have a in particular continuously or uniformly curved surface.

Further preferably, it is provided that the arc-shaped contour is configured with a radius of at most 150 μm, preferably 80 μm, in particular 60 μm. Due to the radius, the difference in height of the personalization layer, i.e. the distance between the principal plane and the point of the respective structure element furthest away from the principal plane, is so small that the personalization layer does not appear disturbed by the structure elements or appears only matt, for example can be recognized with the human eye or a camera. The center point of the radius or point of origin of the radius can lie on the principal plane or be offset from the principal plane, in particular in the direction of the interior of the carrier element, i.e. opposite to the surface. The height of the structure element is thus smaller than when the center point would lie on the principal plane.

Furthermore, it may alternatively be provided that at least one structure element of the plurality of structure elements is configured as a spherical layer and the base circle of the spherical layer faces the carrier element and is arranged in particular in the principal plane.

Further preferably, it is provided that the personalization layer is configured at least partly as a tilt image. The tilt image shows changing information depending on the angle of view from which the personalization layer is viewed. The tilt image has in particular at least two different images. The images here are preferably configured in such a way that a first image is visible if a second image is concealed by the plurality of structure elements and vice versa. The first image here is applied in particular to a first side area of the respective structure elements and the second image is applied in particular to a second side area of the respective structure elements, the first side area being substantially opposite the second side area.

Due to the structure elements, also the applying of a tilt image is easily possible. The structure elements can thus be utilized in a further advantageous way.

The tilt image can also be integrated at least partly, in particular the non-colorful portion or black portion of the tilt image can be integrated at least partly in the carrier element. For example, the tilt image can therefore be configured as an MLI (multiple laser image) or CLI (changeable laser image).

Further preferably, it is provided that the structure elements of the plurality of structure elements each have a height with respect to the principal plane of 10 μm to 60 μm, preferably 20 μm to 50 μm, in particular 30 μm to 40 μm. Due to the corresponding height, which is determined in particular perpendicular to the principal plane, the undesired removal of the personalization layer is further reduced or inhibited. It was found that the structure element with the corresponding height with the previously mentioned values is not or only slightly perceived as disturbing and also a camera has no or only slight difficulties when capturing.

Further preferably, it is provided that the structure elements of the plurality of structure elements are aligned with each other as a uniform grid. Due to the uniform grid, the personalization layer is more homogeneous and viewing is more pleasant. An automatic processing of an image taken of the personalization layer can also be effected more accurate, if the structure elements are configured relative to each other in a uniform grid. For example, an object recognition can be provided as automatic processing.

Further preferably, it is provided that the personalization layer is applied only with colorful color particles. Colorful color particles means in particular no black particles. By means of an LPI method (LPI—laser protected image), at least the contour of a color photo can be made more long-term stable, since a black portion of the personalization layer is incorporated in the interior of the carrier element. But here, too, the colorful color portion of the personalization layer disappears in the course of the working life due to mechanical abrasion and/or detachment of the color layer by chemical influences. It is therefore advantageous, when only the colorful color particles are applied onto the surface and the black particles are integrated into the carrier element.

Further preferably, it is provided that a respective structure element of the plurality of structure elements is configured to be at least partly, in particular completely, transparent. Due to the transparent configuration, color that is incorporated in the carrier element underneath the structure element, i.e. in particular between the structure element and the principal plane, can be captured through the structure element from outside the security document. In case that the carrier element with the structure elements is manufactured in layers, for example the outermost layer or several outermost layers of the carrier element can be configured to be transparent. In the interior of the carrier element built up in layers, at least one layer or the layers are preferably configured to be opaque.

Further preferably, it is provided that a respective structure element of the plurality of structure elements is configured as an optical lens, in particular as a collecting lens. In optics, a lens is a transparent component that deflects light by refraction at its surface. In general, lenses have two refractive areas, at least one of which is bulged convexly or concavely. Lenses that focus parallel light (at least to the focal point) are called collecting lenses. Through the lens light incident on the personalization region can be collected, allowing for example a colored information item or a part of the personalization in the interior of the carrier element to be illuminated more intensely than when this information item were illuminated without a collecting lens. It is further advantageous that the information item appears 3D-like through the lens.

The invention also relates to a method. In the method, a security document with a wear-protected personalization layer is manufactured. The following steps are performed:

a) supplying a carrier element having a surface and a principal plane;

b) determining a personalization region of the surface with a plurality of structure elements which are uniformly aligned with each another, immediately adjacent to each other and raised with respect to the principal plane, and in particular laminated, with a center distance between vertical axes of the respective structure elements of less than 250 μm;

c) applying the personalization layer onto the surface in the personalization region, in particular onto the structure elements; and d) supplying the security document having the carrier element and the applied personalization layer.

In particular, the carrier element is configured of plastic. In particular, the carrier element can be configured in a single-layer or multilayer manner, for example of PVC (polyvinyl chloride) and/or PET (polyethylene terephthalate) and/or ABS (acrylonitrile butadiene styrene) and/or polycarbonate.

In particular, the structure elements are configured of polycarbonate. By Polycarbonate the structure elements can be configured particularly hard and resistant to mechanical impact.

The plurality of structure elements are already configured on the carrier element in particular during the manufacture of the carrier element, for example by injection molding method or by welding under high pressure at an appropriate temperature into a homogeneous inseparable plastic unit, i.e. in particular by lamination.

The personalization layer is applied to the carrier element for example by digital printing, in particular inkjet printing or liquid ink printing.

In particular, it is provided that the plurality of the raised structure elements is configured at the carrier element by lamination, in particular before step b).

The respective objective components of the security document according to the invention are manufactured by the method. The preferred embodiments presented with reference to the respective method according to the invention and their advantages apply accordingly to the security document according to the invention.

Further features of the invention may be found in the claims, in the figures and the description of the figures.

Embodiment examples of the invention will hereinafter be explained more closely with reference to schematic drawings.

BRIEF DESCRIPTION OF THE DRAWINGS

There are shown.

DETAILED DESCRIPTION OF VARIOUS EMBODIMENTS

In the figures, identical or functionally identical elements are provided with the same reference signs.

Figure 1:
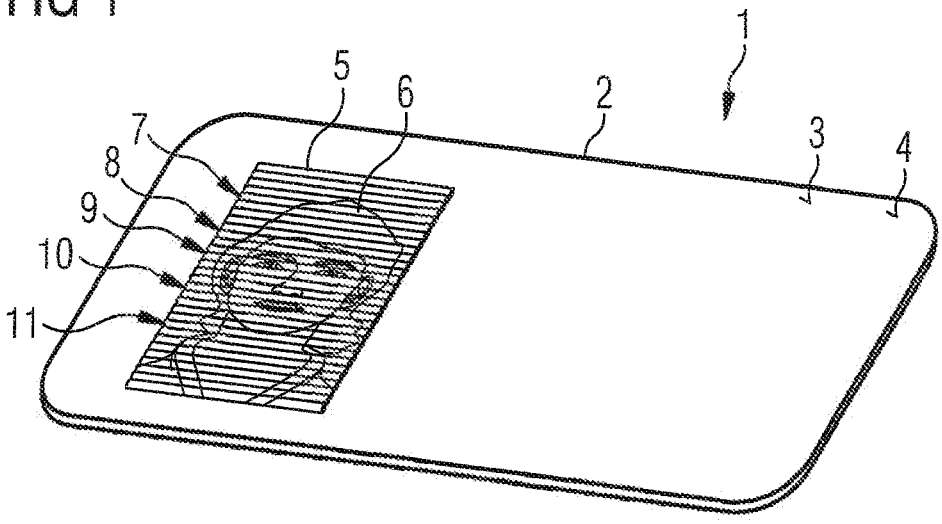
FIG. 1 a schematic representation of an embodiment example of a security document according to the invention with a plurality of structure elements, the structure elements being configured as semicircular rods.

FIG. 1 shows a schematic diagram of a security document 1 according to the invention. According to the embodiment example, the security document 1 is configured as a card, for example an identity card. The security document 1 has a carrier element 2. The carrier element 2 is configured of plastic, for example. The carrier element 2 can be configured in a single-layer or multilayer manner, for example.

The carrier element 2 has a surface 3 which according to the embodiment example is the front side of the card. The carrier element 2 can also have several surfaces, for example a front side and a back side.

The surface 3 has a principal plane 4 and a personalization region 5. According to the embodiment example, the principal plane 4 extends in the region of the surface 3 which is located outside the personalization region 5.

The personalization region 5 has a personalization layer 6. According to the embodiment example, the personalization layer is a color photo which shows a human face. However, the personalization layer 6 can also be configured as a diverse individual print or diverse individual lettering. In particular, the personalization layer 6 is characterized in that the personalization layer 6 is applied to the surface 3 of the carrier element 2 for a long time, i.e. preferably at least for a period of several months, in particular at least one year or even up to ten years.

The carrier element 2 is configured with a plurality of structure elements 7 in the personalization region 5. The structure elements of the plurality of structure elements 7, also referred to as structure elements 7 for short, are configured in a raised manner with respect to the principal plane 4, in particular such that they protrude from the carrier element 2 or are directed away with respect to the same. In addition, according to the embodiment example, the structure elements of the plurality of structure elements 7 are arranged uniformly.

According to the embodiment example of FIG. 1, the structure elements of the plurality of structure elements 7 have, in cross-section perpendicular to the principal plane 4, at least partly an arc-shaped contour 8.

The arc-shaped contour 8 has a radius 9 which according to the embodiment example is in particular up to 70 μm. A center point 25 of the radius 9 or point of origin of the radius 9 lies in the principal plane 4 according to the embodiment example.

However, in an embodiment not shown, the center point 25 of the radius 9 can also be arranged offset from the principal plane 4, in particular in the direction of the interior of the carrier element 2, i.e. opposite to the surface 3.

In particular, the structure elements of the plurality of structure elements 7 according to FIG. 1 are respectively configured as semicircular rods 10. A flat principal area 11 of the respective semicircular rod 10 is arranged in the principal plane 4.

Figure 2:
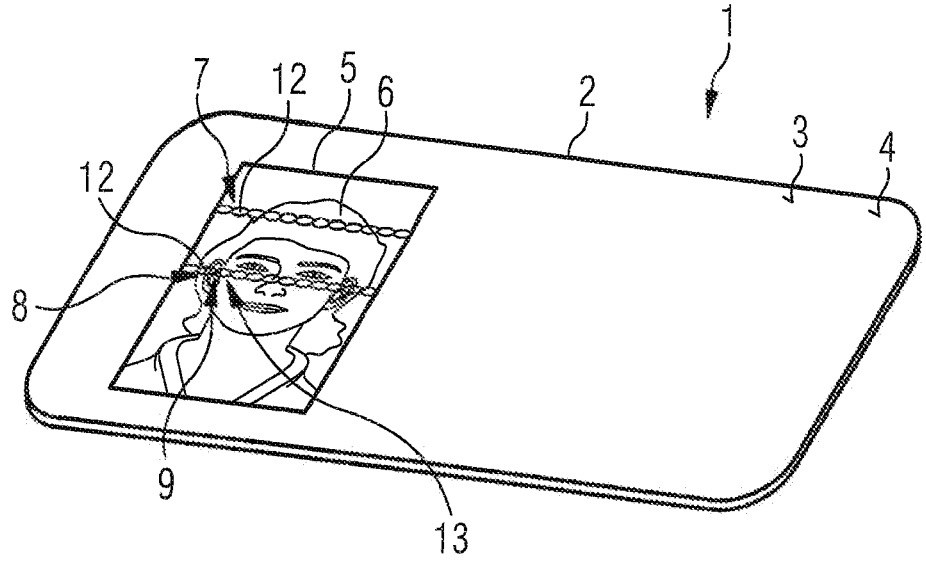
FIG. 2 a schematic representation of a further embodiment example of the security document, the structure elements being configured as a hemisphere.

According to the embodiment example of FIG. 2, the structure elements of the plurality of structure elements 7 are respectively configured as a spherical segment 12. A sectional area 13 of the respective spherical segment 12 faces the carrier element 2. Furthermore, the sectional area 13 is arranged in the principal plane 4.

According to FIG. 1 as well as according to FIG. 2, the structure elements of the plurality of structure elements 7 are arranged uniformly.

Figure 3:
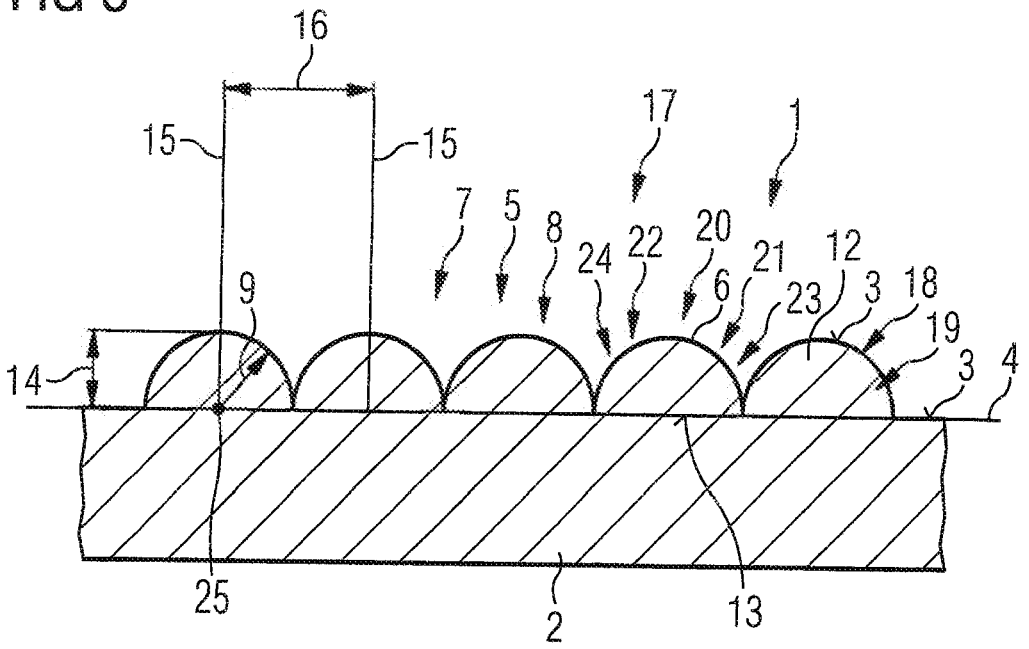
FIG. 3 a schematic sectional view perpendicular to a principal plane of the security document of a further embodiment example of the security document, a surface of a carrier element of the security element being configured outside a personalization region in the principal plane.
Figure 4:
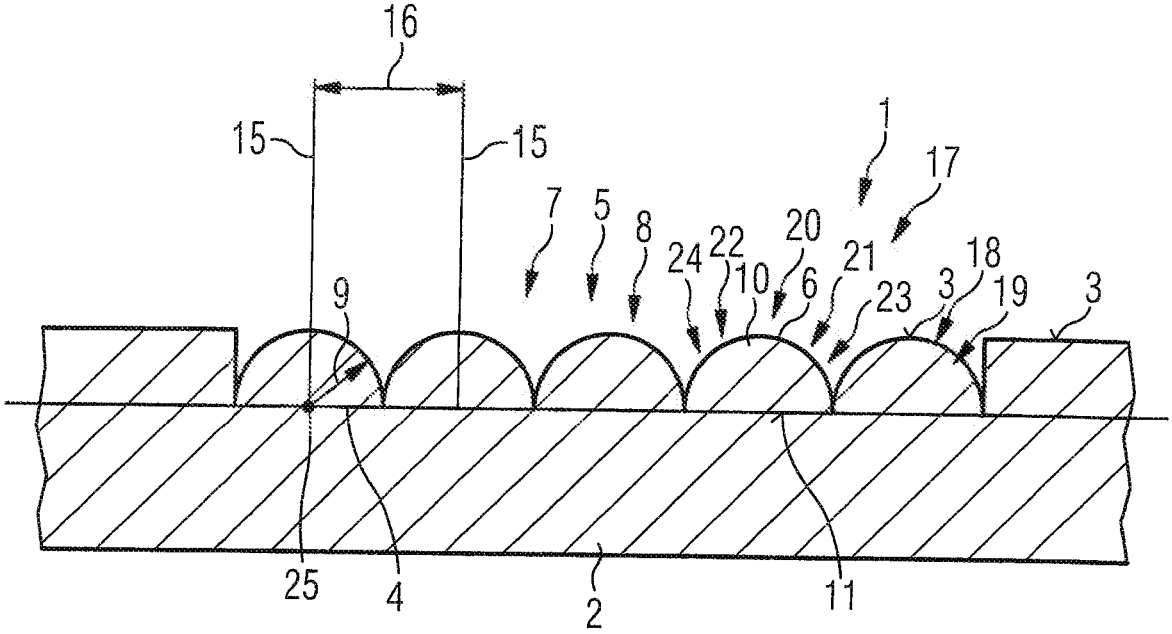
FIG. 4 a further schematic sectional view perpendicular to the principal plane of a further embodiment example of the security document, the surface outside the personalization region being configured offset parallel to the principal plane.

FIG. 3 and FIG. 4 show a cross-sectional view of the structure elements of the plurality of structure elements 7 perpendicular to the principal plane 4, as it may be present for both the semicircular rods 10 according to FIG. 1 and the spherical segments 12 according to FIG. 2.

Furthermore, a respective structure element of the plurality of structure elements 7 has a height 14 with respect to the principal plane 4. The height 14 is in particular between 10 μm and 60 μm.

A respective structure element of the plurality of structure elements 7 has a vertical axis 15. According to the embodiment example, the vertical axis 15 is perpendicular to the principal plane 4. Furthermore, the vertical axis 15 runs in particular through the point of the respective structure element 7 which is furthest away from the principal plane 4 and/or from the carrier element 2. The structure elements 7 are configured with a center distance 16 between the vertical axes 15 of the structure elements 7 of less than 180 μm, preferably less than 150 μm, more preferably less than 130 μm, in particular less than 100 μm. Preferably, the center distance 16 is at least 50 μm, more preferably 80 μm, in particular 100 μm.

The structure elements of the plurality of structure elements 7 are arranged immediately adjacent to each other, i.e. a distance between the structure elements 7 is substantially equal to zero. Preferably, the structure elements 7 are arranged immediately adjacent to each other in two dimensions, in particular parallel to the principal plane. However, the structure elements 7 can also be immediately adjacent to each other in only one dimension, as is shown in FIG. 2.

The structure elements of the plurality of structure elements 7 are aligned with each other in particular as a uniform grid 17.

The personalization layer 6 is preferably applied only with colorful color particles 18. Any non-colorful color particles 19 remaining in comparison to the colorful color particles 18, in particular the black color particles, are preferably not applied to the surface 3, but integrated or embedded into the carrier element 2.

The personalization region 5 extends in particular only partly over the surface 3. Alternatively, the personalization region 5 may also extend completely over the entire surface 3.

The principal plane 4 is arranged in particular in the plane of the principal area 11 or the sectional area 13.

The basic idea of the security document 1 is to create the personalization layer 6, which on the one hand enables the use of standard inkjet inks with a less good bond to the surface 3 or to the substrate (card surface or document surface), but also to enable polycore inks with a very good bond to the substrate and to simultaneously exhibit a high stability of the personalization or of the personalization layer 6 against mechanical and/or chemical influences.

The security document 1 as well as a method for manufacturing the security document 1 can increase the long-term resistance of cards and identity documents having external personalization or personalization layer 6.

Furthermore, the security document 1 can be made more forgery-proof by the plurality of structure elements 7. Often, known security documents are forged by ironing a new personalization layer over an original personalization layer. In the embodiment example of the security document 1 with the structure elements 7, ironing over the existing personalization layer 6 leads to the fact, that the structure elements 7 melt at least partly or are compressed at least partly. Such a forgery can then be recognized more easily than when a known security document is ironed over.

According to FIG. 3, the structure elements 7 or the plurality of structure elements 7 are respectively configured as the spherical segment 12, and the principal plane 4 extends at least partly in the surface 3 of the carrier element 2 outside the personalization region 5. According to FIG. 4, the structure elements 7 or the plurality of structure elements 7 are respectively configured as a semicircular rod 10, the principal plane 4 runs at least partly, in particular parallel, offset to the surface 3 of the carrier element 2 outside the personalization region 5. But it is also possible that the configuration of the structure elements of FIG. 3 is combined with the course of the surface 3 outside the personalization region 5 of FIG. 4 and that the configuration of the structure elements of FIG. 4 is combined with the course of the surface 3 outside the personalization region 5 of FIG. 3.

According to a further embodiment example, the personalization layer 6 is configured as a tilt image 20. The tilt image 20 shows changing information depending on the viewing angle from which the personalization layer 6 is viewed. The tilt image 20 has in particular at least two different images 21, 22. The images 21, 22 here are preferably configured in such a way that a first image 21 is visible if a second image 22 is concealed by the plurality of structure elements 7 and vice versa. The first image 21 here is applied in particular to a first side area 23 of the respective structure elements 7 and the second image 22 is applied in particular to a second side area 24 of the respective structure elements 7, the first side area 23 being substantially opposite the second side area 24.

The invention claimed is:

1. A security document having a carrier element which has a surface with a principal plane and a personalization region, wherein in the personalization region a personalization layer is applied to the surface, wherein the surface of the carrier element in the personalization region is configured with a plurality of structure elements uniformly aligned with each other and raised with respect to the principal plane, wherein the structure elements of the plurality of structure elements are configured immediately adjacent to each other and wherein the structure elements are configured with a center distance between vertical axes of the respective structure elements of less than 250 μm;

wherein the personalization layer is applied only with colorful color particles defined as being without black particles;

wherein a black portion comprising black particles is integrated into the interior of the carrier element to define at least a contour of a personalization image;

wherein the personalization layer is disposed on the structural elements such that the structural elements are at least partially covered by the colorful color particles;

wherein a respective structure element of the plurality of structure elements is configured at least partly transparent;

wherein a respective structure element of the plurality of structure elements is configured as an optical lens;

wherein the colorful color particles of the personalization layer and the black portion integrated into the carrier element together form the personalization image, the personalization image being an image of a human face.

2. The security document according to claim 1, wherein at least one structure element of the plurality of structure elements, in cross-section perpendicular to the principal plane, has at least partly an arc-shaped contour.

3. The security document according to claim 2, wherein the arc-shaped contour is configured with a radius of at most 125 μm.

4. The security document according to claim 1, wherein at least one structure element of the plurality of structure elements is configured in a dome-shaped manner on the side facing away from the carrier element.

5. The security document according to claim 1, wherein at least one structure element of the plurality of structure elements is configured as a spherical segment and the sectional area of the spherical segment faces the carrier element.

6. The security document according to claim 1, wherein at least one structure element of the plurality of structure elements is configured as a semicircular rod.

7. The security document according to claim 1, wherein the personalization layer is configured at least partly as a tilt image.

8. The security document according to claim 7, wherein the tilt image comprises a first image and a second image, the first image being applied to a first side area of the plurality of structure elements and the second image being applied to a second side area of the plurality of structure elements, and the first side area being substantially opposite the second side area.

9. The security document according to claim 1, wherein the structure elements of the plurality of structure elements respectively have a height with respect to the principal plane of 10 μm to 60 μm.

10. The security document according to claim 1, wherein the structure elements of the plurality of structure elements are aligned with each other as a uniform grid.

11. The security document according to claim 1, wherein the black portion of the personalization layer comprises a tilt image that is partly integrated into the carrier element.

12. A method for manufacturing a security document with a wear-protected personalization layer, comprising the steps of:

a) supplying a carrier element with a surface and a principal plane;

b) determining a personalization region of the surface with a plurality of structure elements which are uniformly aligned with each another, immediately adjacent to each other and raised with respect to the principal plane, with a center distance between vertical axes of the respective structure elements of less than 250 μm;

c) applying the personalization layer onto the surface in the personalization region; and d) supplying the security document having the carrier element and the applied personalization layer;

wherein a respective structure element of the plurality of structure elements is configured at least partly transparent;

wherein the personalization layer is applied only with colorful color particles defined as being without black particles;

wherein a black portion comprising black particles is integrated into the interior of the carrier element to define at least a contour of a personalization image;

wherein a respective structure element of the plurality of structure elements is configured as an optical lens;

wherein the colorful color particles of the personalization layer and the black portion integrated into the carrier element together form the personalization image, the personalization image being an image of a human face.

13. The method according to claim 12, wherein the plurality of raised structure elements is configured by lamination at the carrier element.

14. The method according to claim 12, wherein the personalization layer is disposed above the structural elements such that the structural elements are covered by the personalization layer.

* * * * *